United States Patent [19]

Lindner

[11] Patent Number: 4,583,920

[45] Date of Patent: Apr. 22, 1986

[54] POSITIVE DISPLACEMENT DIAPHRAGM PUMPS EMPLOYING DISPLACER VALVES

[75] Inventor: Georg H. Lindner, Vlissingen, Netherlands

[73] Assignee: M&T Chemicals Inc., Woodbridge, N.J.

[21] Appl. No.: 566,363

[22] Filed: Dec. 28, 1983

[51] Int. Cl.[4] ..... F04B 3/00; F04B 43/06

[52] U.S. Cl. ..... 417/266; 417/317; 417/395

[58] Field of Search ..... 417/244, 395, 510, 497, 417/254, 259, 264, 266, 317, 479

[56] References Cited

U.S. PATENT DOCUMENTS

| | | | |
|---|---|---|---|
| 1,029,232 | 6/1912 | Schaefer et al. | 417/497 |
| 2,383,193 | 8/1945 | Herbert | 417/317 |
| 2,711,134 | 6/1955 | Hughes | 417/395 |
| 2,821,930 | 2/1958 | Smith | 417/317 |
| 3,013,575 | 9/1959 | Persson . | |
| 3,148,624 | 9/1964 | Baldwin . | |
| 3,240,152 | 3/1966 | Bower, Jr. . | |
| 3,256,825 | 6/1966 | Limpert et al. | 417/395 |
| 3,285,182 | 11/1966 | Pinkerton . | |
| 3,386,388 | 6/1968 | Rosenberg | 417/395 |
| 3,387,566 | 6/1968 | Temple | 417/403 |
| 3,461,808 | 8/1969 | Nelson et al. . | |
| 3,514,227 | 5/1970 | Rupp . | |
| 3,666,379 | 5/1972 | Mitchell et al. . | |
| 3,781,141 | 12/1973 | Schall . | |
| 3,814,548 | 6/1974 | Rupp . | |
| 3,816,034 | 6/1974 | Rosenquest, Jr. . | |
| 4,021,149 | 5/1977 | Rutenberg et al. . | |
| 4,021,164 | 5/1977 | Tell . | |
| 4,042,311 | 8/1977 | Yonezawa . | |
| 4,047,844 | 9/1977 | Robinson | 417/395 |
| 4,093,406 | 6/1978 | Miller . | |
| 4,104,008 | 8/1978 | Hoffmann et al. . | |

*Primary Examiner*—Cornelius J. Husar
*Assistant Examiner*—Peter M. Cuomo
*Attorney, Agent, or Firm*—S. H. Parker; J. Matalon; R. E. Bright

[57] ABSTRACT

A positive displacement pump utilizes at least three driven displacer valves and a plurality of driving membranes and at least one pumping membrane to withdraw minute quantities of corrosive fluid from a drum and discharge same from a spray nozzle. The pump is submerged within the fluid to be pumped and is driven by a remotely positioned pneumatic pulse generator comprising pneumatic logic circuitry. The driven displacer valves operate in a particular sequence to draw fluid into the pump body, advance same from pumping chamber to pumping chamber within the pump body, and then discharge same at a constant rate of discrete pulses through an outlet port. The pulse generator and logic circuitry provide the control pulses for operating the displacer valves at the proper times in the operational cycle. The delivery characteristics of the instant pump far exceed the performance capabilities of conventional pumps utilized for similar purposes.

7 Claims, 8 Drawing Figures

POSITIVE DISPLACEMENT DIAPHRAGM PUMPS EMPLOYING DISPLACER VALVES

BACKGROUND OF THE INVENTION

1. Related Application(s)

In order to more fully appreciate the significance of the instant invention, related co-pending U.S. patent application Ser. No. 385,176, filed June 4, 1982, now U.S. Pat. No. 4,500,264, on behalf of George H. Lindner should be carefully reviewed.

2. Field of the Invention

The present invention relates generally to air operated, positive displacement diaphragm pumps that are submerged in the liquid to be discharged, and more particularly to diaphragm pumps employing a plurality of displacer valves.

3. Prior Art

Diverse diaphragm pumps have been used in the prior art to withdraw liquid from a receptacle through an inlet port and discharge same through an outlet port. The diaphragm usually divides the pump housing into a supply chamber and a pressure chamber. A first check valve regulates flow into the supply chamber, and a second check valve controls the flow therefrom. Electrical or hydraulic signals are supplied to an externally situated operator, such as a piston, for controlling the movement of a diaphragm or membrane within the pump casing. The movement of the diaphragm forces the pressurized fluid out of the supply chamber and past the second check valve. Representative reciprocating diaphragm pumps are shown in U.S. Pat. No. 3,285,182, granted Nov. 15, 1966 to H. E. Pinkerton, U.S. Pat. No. 3,814,548, granted June 4, 1974 to Warren E. Rupp, and U.S. Pat. No. 4,021,164, granted May 3, 1977 to Hans Peter Tell.

Known reciprocating diaphragm pumps of low capacity, however, have very little, if any, self-priming action. Such pumps therefore must be kept at a level close to, or below, the liquid level of the container from which the liquid is being pumped. Also, check valves of known reciprocating pumps exhibit a tendency to leak. While the leakage is a minor problem when relatively large quantities of liquid are being pumped, the problem assumes far greater importance when the quantities being pumped are but a few milliliters over an extended period of time and when exact metering is required.

The first of the aforementioned shortcomings of known reciprocating diaphragm pumps was remedied by the diaphragm pump, shown in detail in FIGS. 2–5 of aforementioned, co-pending patent application Ser. No. 385,176, U.S. Pat. No. 4,500,264. To illustrate, the diaphragm pump shown and described in the co-pending application responds to control pulses of low pressure air delivered from a pulse generator controlled by pneumatic logic circuitry; the low pressure air is readily available in industrial plants and represents a marked cost saving over known electrical and hydraulic control systems. Also, the driving membrane, pumping membrane, and displacer of the co-pending application function effectively to discharge small quantities of liquid at a selected rate; by manipulation of a resistor in the logic circuitry, the rate can be varied. Additionally, the diaphragm pump of the co-pending application can be submerged in the liquid to be discharged, even a corrosive liquid, and function satisfactorily over extended periods of time and with constant, reproducible discharge rates.

While the diaphragm pump of the aforesaid co-pending application represents a significant advance over known diaphragm pumps, extensive field tests of said pump, while handling corrosive liquids such as tin compounds for hot coating glass bottles, suggested even further refinements in the pump design would be desirable. For example, the instant diaphragm pump obviates the use of an inlet check valve and an outlet check valve, replacing such valves by a pair of positively driven displacer valves. The pair of positively driven valves, when coupled with the conventional positively driven diaphragm valve, coact to force a metered amount of corrosive liquid through the pump body in a sequence of steps. The concept of the three positively driven displacer valves used in the instant diaphragm pump can be extended to four or more displacer valves, as desired or as needed, for successful low volume operation.

Additionally, the instant positive displacement diaphragm pump can be controlled by a pneumatic pulse generator comprising a logic circuit of simplified design. The instant positive displacement diaphragm pump is compatible with the logic circuit shown in FIG. 6 of co-pending application Ser. No. 385,176, U.S. Pat. No. 4,500,264, an can function in concert with other pneumatic and pure-fluid logic circuits with equal facility.

SUMMARY OF THE INVENTION

The present invention contemplates a positive displacement diaphragm pump employing three, or more, displacer valves for drawing liquid into the pump body, pressurizing same, and discharging same at a constant, low volume flow rate over extended periods of time.

The present positive displacement diaphragm pump is reliable, leak-proof, and can withstand submersion in corrosive liquids. The problem of leakage associated with known check valves, such as spring loaded ball valves, has been obviated.

Furthermore, the present positive displacement diaphragm pump is substantially self-priming in operation, provides reproducible results over extended periods of time, operates reliably with a low pressure head, and yet discharges minute quantities of liquid in a series of discrete pulses.

Lastly, the present positive displacement diaphragm pump can be operated by low pressure air pulses supplied thereto from known pulse generators comprising a pneumatic logic circuit of simplified design. Additionally, even in the unlikely instance of membrane failure, the air pressure is sufficient to keep the corrosive liquid from entering the pulse generator and destroying same.

Yet other advantages of the present positive displacement diaphragm pump will become readily apparent to the skilled artisan from the appended drawings and the accompanying detailed description.

DESCRIPTION OF THE PREFERRED EMBODIMENT

Figure 1:
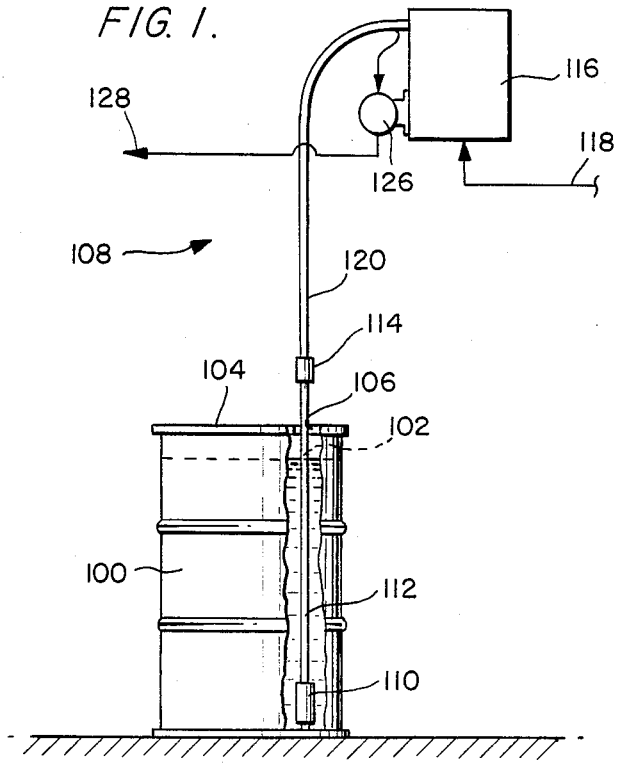
FIG. 1 is a side elevational view of an air operated diaphragm pump system constructed in accordance with the principles of the instant invention, said system being shown in operative association with a drum filled with liquid.

Turning now to the drawings, FIG. 1 depicts a large metallic drum 100 having a capacity of 80 gallons. The liquid level line is indicated by dotted line 102, and a fragment of the drum has been removed to show the interior thereof. A lid 104 seals the open upper end of the drum 100, and an aperture 106 is formed through the lid.

An air operated, diaphragm pump assembly, indicated generally by reference numeral 108, is operatively connected to the drum for draining its contents. The assembly 108 comprises a conventional diaphragm pump 110 positioned on, or closely adjacent to, the bottom of drum 100, an extension sleeve 112 projecting upwardly from the pump through the aperture 106, and a collar 114 secured to the upper end of the extension sleeve. The diaphragm pump assembly further includes a pulse generator 116, an air supply line 118 for delivering pressurized or compressed air to the pulse generator, and a conduit 120 which extends from the pulse generator, to collar 114 on extension sleeve 112, and into communication with pump 110. Conduit 120 and sleeve 112 contain three air pulse hoses, one return-pressure hose and the pump delivery hose. The last hose is connected to sight glass 126, and terminates at delivery point 128. Extension sleeve 112 is more or less rigid and has a liquid tight connection to pump 110. The sleeve protects the hoses in it from attack by the liquid in drum 100. Conduit 120 is flexible and allows the pump to be moved into, and from, the drum.

Figure 2:
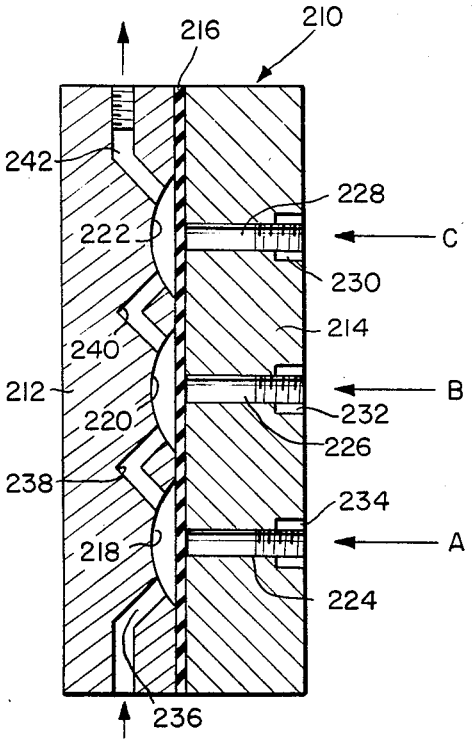
FIG. 2 is a vertical cross-sectional view of a first embodiment of a unique diaphragm pump utilized in the system of FIG. 1, such view being taken on an enlarged scale.

FIG. 2 depicts schematically a first embodiment of a diaphragm pump 210 that was intended to be substituted for conventional pump 110 in the air operated pump system of FIG. 1. Pump 210 comprises a body composed of a left hand segment 212 and a right hand segment 214 with a single, flexible membrane 216 disposed therebetween. Three spaced hemispherical chambers 220, 218 and 222 are defined in the segment 212, and three channels 224, 226 and 228 are drilled, bored or otherwise formed through segment 214. Threaded connections 230, 232 and 234 are formed at the outer ends of each channel, and suitable hoses (not shown) are threadedly secured thereto. An inlet conduit 236 extends from the lower edge of segment 212 to chamber 218, a first internal conduit 238 extends from chamber 218 upwardly to chamber 220, a second internal conduit 240 extends from chamber 220 upwardly to chamber 222, and an outlet conduit 242 leads from chamber 222 to the upper edge of segment 212.

The pump 210 is submerged in the liquid to be pumped, such liquid being retained in a drum or other suitable receptacle. Pulses of air, at a pressure slightly greater than atmospheric air, are delivered in a predetermined sequence to the conduits in segment 214. More specifically, the submersion of pump 210 forces at least a limited quantity of liquid into chamber 218. Then, when a first pulse of air is delivered from a pulse generator, such as pulse generator 116, to conduit 224, the membrane 216 is forced to assume a concave shape and force the liquid in chamber 218 through conduit 238 into second cavity 220. For the duration of pulse A, the membrane flexing in chamber 218 serves as a check valve to prevent the liquid from flowing back down inlet conduit 236.

When a second pulse B of air is delivered from the pulse generator to conduit 226, the membrane assumes a concave shape and forces the fluid in chamber 220 through conduit 240 into the third chamber 222. For the duration of pulse B, the membrane flexing in chamber 220 serves as a check valve to prevent the liquid from flowing downwardly in the pump body. The pulse A may be terminated while B is still operational.

When a third pulse C of air is delivered from the pulse generator 116 to conduit 228 over one of the three air pulse hoses retained in conduit 120, the membrane assumes a concave shape and forces the fluid in chamber 222 upwardly through conduit 242 for discharge at a remote discharge point. Here again, for the duration of pulse C, the membrane flexing in chamber 222 serves as a check valve to prevent the liquid from flowing downwardly in the pump body.

When the pressure produced by the delivery of air pulses to conduit 224 is removed, the membrane 216 returns to its unstressed condition and chamber 218 becomes filled with liquid again. Removal of the pressure from conduit 226 will similarly allow the membrane to return to its unstressed condition and cause chamber 220 to fill with liquid. To complete the pumping cycle, pulses of air are again delivered to conduit 224, removed from conduit 228, and subsequently delivered to conduit 226. Each operational cycle of pump 210 will deliver an amount of liquid governed by the volume of chamber 220.

Whereas chambers 218, 220 and 222 of pump 210 shown in FIG. 2 are equal in volume, it should be noted that this size relationship may be altered to fit different operational requirements. To illustrate, if chamber 222 were made to be one-half the volume of chamber 220, the pump would deliver one-half of its liquid output upon the delivery of pulses of air pressure to conduit 226, and the other half of its liquid output (for each cycle of operation) upon the delivery of pulses of air pressure to conduit 230. In the event that the pump was formed with more than three chambers, for example "n" chambers, the liquid output for each cycle of operation could be divided into $n-1$ pulses per pump cycle, by the judicious selection of the chamber volumes.

Whereas the pump 210 functions satisfactorily, and is superior to known diaphragm operated pumps, the membrane 216 poses some problems. Thus, when the membrane 216 is fabricated of natural rubber, the pump works well for several days, but the pump capacity diminishes gradually thereafter as slack in the membrane increases. When the membrane 216 is fabricated from a plastic, such as Viton, the membrane stretches even more quickly and the pump capacity diminishes in the same fashion. Techniques such as pre-stretching the membrane and/or providing a spring return arrangement for the membrane failed to solve this problem.

Figure 3:
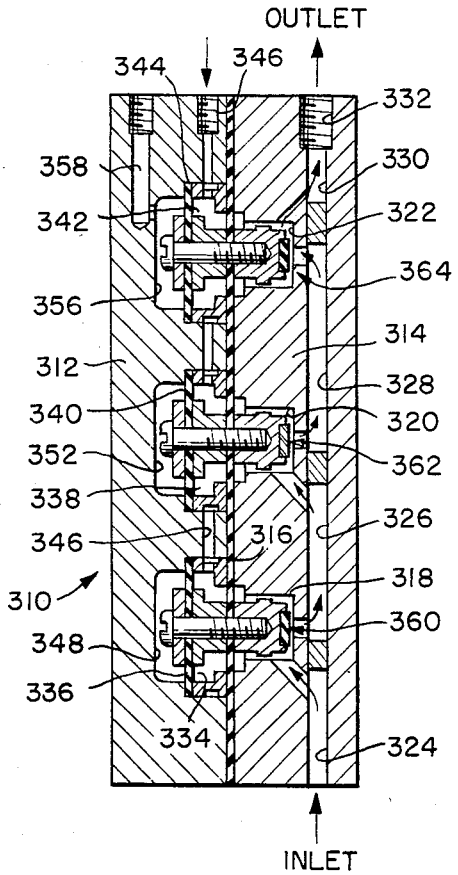
FIG. 3 is a full scale vertical cross-sectional view of a second embodiment of a unique diaphragm pump utilized in the system of FIG. 1.

FIG. 3 depicts schematically a second embodiment of a diaphragm pump 310 that was substituted for pump 110 in the air operated pump system of FIG. 1. Pump 310 represents an improvement over pump 210 and solves the longevity problem associated with the diaphragm 216 in pump 210. Additionally, pump 310 positively returns the diaphragm to its unstressed, at rest position, without resorting to metal biasing springs or pre-stretched membranes.

Pump 310 comprises a body composed of a left hand segment 312 and a right hand segment 314 with a single, flexible pumping membrane 316 disposed therebetween. First, second and third spaced pumping chambers 318, 320 and 322 are defined in segment 314. An inlet conduit 324 extends from the lower edge of segment 314 upwardly to first pumping chamber 318, and a first internal conduit 326 extends between chamber 318 and second pumping chamber 320. A second internal conduit 328 extends between chamber 320 and third pumping chamber 322, and an outlet conduit 330 extends between chamber 322 and the upper end of the pump housing. An enlarged threaded port 332 is formed at the end of conduit 330 to receive a threaded hose or pipe (not shown) to transmit the liquid to a remote location for discharge.

A first intermediate chamber 334 is defined in the lower end of segment 312 between small driving membrane 336 and pumping membrane 316. A second intermediate chamber 338 is defined near the middle of segment 312 between small driving membrane 340 and pumping membrane 316. A third intermediate chamber 342 is defined in the upper end of segment 312 between small driving membrane 344 and pumping membrane 316. A vertically oriented passage 346 extends downwardly from the upper end of segment 312 through chambers 334, 338 and 342. Consequently, when a reference pressure is introduced into passage 346, all of the membranes are subjected to the same pressure. The small driving membranes 336, 340, 344 are identical in size, shape and function; such membranes obviate the need for return springs and function satisfactorily over extended periods of time.

Figure 4:
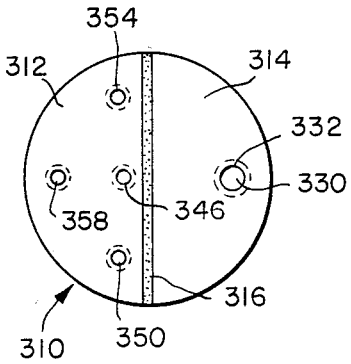
FIG. 4 is a top plan view of the diaphragm pump of FIG. 3.

A first pressure chamber 348 is defined between driving membrane 336 and a cavity formed in the lower end of segment 312; a first control conduit 350 extends from the top of segment 312 directly into the cavity. Control conduit 350 is not shown in FIG. 3, but is shown in FIG. 4. A second pressure chamber 352 is defined between driving membrane 340 and a cavity formed in the middle of segment 312; a second control conduit 354 extends from the top of segment 312 directly into the cavity. Control conduit 354 is not shown in FIG. 3, but is shown in FIG. 4. A third pressure chamber 356 is defined between driving membrane 344 and a cavity formed in the upper end of segment 312. A third control conduit 358 extends from the top of segment 312 directly into the upper cavity, as shown in FIG. 3.

A first displacer valve, indicated generally by reference numeral 360, is utilized to force the liquid from pumping chamber 318 via internal conduit 326 into second pumping chamber 320. A second, identical displacer valve, indicated generally by reference numeral 362, is utilized to force the liquid from pumping chamber 320 via internal conduit 328 into third pumping chamber 322. A third identical displacer valve, indicated generally by reference numeral 364, is utilized to force the liquid from chamber 322 via conduit 330 through port 332 into a hose or pipe (not shown) for discharge at a remote location.

Figure 5:
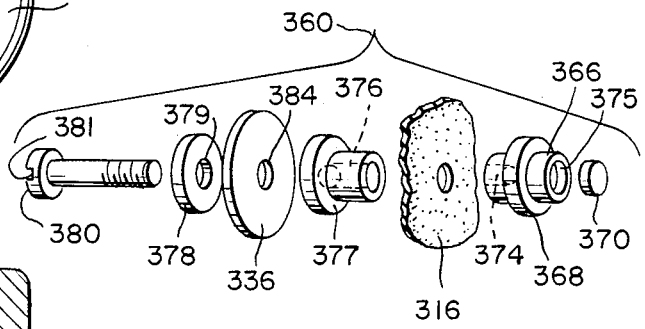
FIG. 5 is an exploded perspective view of a displacer valve utilized within the diaphragm pump shown in FIGS. 3–4.

FIG. 5 shows an exploded perspective view of representative displacer valve 360. Displacer valves 360, 362 and 364 are identical in construction and function.

Displacer valve 360 includes a cylindrical cap 366 with an enlarged annular shoulder 368 that guides the movement of the cap within pumping chamber 318. A button 370 of a resilient, chemically inert material fits wihtin an aperture 375 in the working face of the valve, and a central bore 374 extends into, but not through, the cap 366; the bore is shown in dotted outline. The valve also comprises a spacer 377 with a bore 376 extending therethrough, an annular clamping plate 378 with a hole 379 therethrough, and an elongated screw 380 with an enlarged head. A slot 381 is formed in the head to admit a screwdriver or similar tool.

The shank of screw 380 extends through the aperture 379 in clamping plate 378, through a small central aperture 384 in driving diaphragm 336, through bore 376 in spacer 377, through a small aperture in pumping diaphragm 316, and into the bore 374 in cap 366. The displacer valve 360 employs the screw 380 to secure the valve to the diaphragms, as well as to join the components of the valve into a unitary structure.

Pump 310, as shown in FIGS. 3–5, functions in the following manner. A reference pressure is introduced over passage 346 to pressurize the intermediate chambers 334, 338 and 342. The pump is submerged in the liquid to be discharged, and some of the liquid moves upwardly into the lower pumping chamber 318 to prime same. A first control pulse of air is then introduced at conduit 350, which momentarily raises the pressure in the first pressure chamber 348 to a level greater than that of the intermediate, or reference, chamber 334. The driving diaphragm 336 flexes toward diaphragm 316 and the cap moves rightward within chamber 318 until the button 370 abuts against the wall defining the chamber. The liquid previously retained within pumping chamber 318 is forced through internal conduit 326 into second pumping chamber 320. The control pulse is of sufficient duration to retain the button against the chamber wall to prevent leakage back into first pumping chamber 318 and inlet conduit 324.

After the second pumping chamber 320 is filled, a second control pulse of air is introduced at conduit 354, which momentarily raises the pressure in the second pressure chamber 352 to a level greater than that of the intermediate, or reference, chamber 338. The driving diaphragm 340 flexes toward pumping diaphragm 316 and the cap 366 moves rightward within chamber 320 until the button abuts against the wall defining the chamber. The liquid previously retained within pumping chamber 320 is forced through internal conduit 328 into third pumping chamber 322. The control pulse appearing at conduit 324 is of sufficient duration to retain the button against the chamber wall to prevent leakage; the control pulse appearing at conduit 350 may be terminated.

After the third pumping chamber 322 is filled, a third control pulse of air is introduced at conduit 358, which momentarily raises the pressure in the third pressure chamber 356 to a level greater than that of the intermediate, or refernece, chamber 342. The driving diaphragm 344 flexes toward pumping diaphragm 316 and the cap 366 moves rightward within chamber 322 until the button abuts against the wall defining the chamber. The liquid previously retained within third pumping chamber 322 is forced through outlet conduit 330 and outlet port 332 into a hose (not shown) to be discharged at a remote location.

Figure 7:
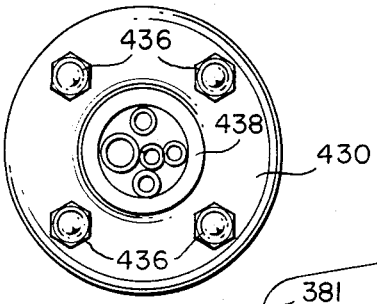
FIG. 7 is a top plan view of the diaphragm pump shown in FIG. 6.
Figure 6:
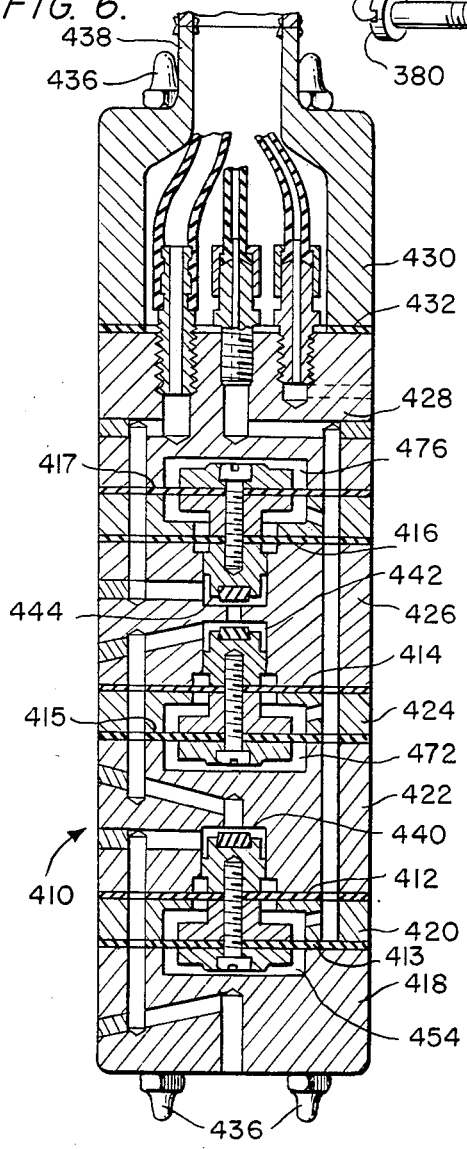
FIG. 6 is a vertical cross-sectional view of a third embodiment of a unique diaphragm pump utilized in the system of FIG. 1.

FIGS. 6–7 depict a third embodiment 410 of a diaphragm operated pump that can be substituted for pump 110 in the air operated pump system of FIG. 1. Pump 410 functions in much the same manner as pump 310, described in detail above with particular reference to FIGS. 3–5. However, while pump 310 relies upon one pumping diaphragm 316 extending throughout the pump housing, pump 410 utilizes three smaller pumping diaphragms 412, 414 and 416 for the same purpose. Three driving diaphragms 413, 415 and 417 are operatively associated with the pumping diaphragms. While pump 310 relies upon a pump body formed of but two segments 312, 314, the body of pump 410 is formed of a plurality of smaller segments 418, 420, 422, 424, 426, 428 and 430. A sealing gasket 432 is located between adjacent segments 428 and 430, while the other segments are sealed by the driving diaphragms and pumping diaphragms. Four elongated threaded rods extend throughout the body of the pump. Nuts 436 are advanced on the opposed ends of the rods to draw the multiplicity of segments together, and a collar 438 at the upper end of segment 430 is secured to the extension sleeve 112 shown in FIG. 1.

While pump 310 has its unitary pumping diaphragm oriented vertically, pump 410 employs three horizontally disposed, and smaller, pumping diaphragms 412, 414 and 416 that are responsive to horizontally disposed driving diaphragms 413, 415 and 417. While pump 310 has pumping chambers 318, 320 and 322 oriented in the same manner, only pumping chambers 440 and 442 are oriented in the same manner; pumping chamber 444 is oriented 180° out of phase with the other two pumping chambers.

While pump 310 functions satisfactorily, a problem was encountered during field tests with leakage between the pump and extension sleeve 112. The leakage problem was compounded by the corrosive nature of the liquid being pumped. Thus, the preferred configuration of pump 410 was evolved, which overcame the leakage problem yet functioned with results comparable to those obtained with pump 310.

Since pumps 310 and 410 utilize driving diaphragms and at least one pumping diaphragm, even in the unlikely event that one of the driving diaphragms should fail, the liquid being handled by the pump could not enter the pulse generator and contaminate same. At worst, the pressurized air could leak through the pumping diaphragm and enter the liquid, but the reverse is precluded.

Figure 8:
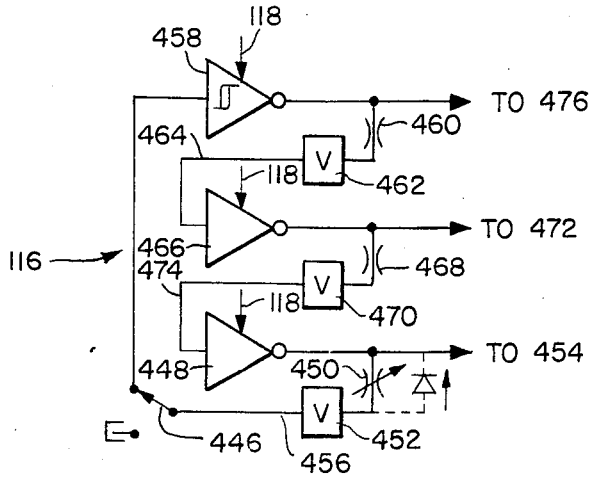
FIG. 8 is a schematic representation of the pneumatic logic circuitry that forms a pulse generator for operating the various embodiments of the diaphragm pump.

FIG. 8 reveals the logic circuit that functions as a pulse generator 116 for the air operated pump system. The pulse generator delivers low pressure air pulses of the requisite duration, and magnitude, to known pumps 110, as well as to the unique pumps 210, 310 and 410. The pulse generator also delivers such pulses to the displacer valves in the proper timing sequence to insure the leakproof operation of the various pumps.

Pulse generator 116, is comprised of well known, commercially available fluid logic elements, such as those sold by Samsomatic Ltd., Fairfield, New Jersey or Samson AG of Frankfort, W. Germany. A manual switch 446 is incorporated into the pulse generator; such switch, which is shown in its operative position, is moved to either a venting position or a closed position (as shown) when the contents of a receptacle 100 have been drained and a new receptacle is being positioned to receive pump 110, 210, 310 or 410.

Pulse generator 116 which is pressurized over air supply line 118, includes pneumatic switches 448 and 466 and also a so-called Schmitt-trigger 458. Switches 448 and 466 change state at a pressure somewhat above zero pressure and somewhat below the maximum system pressure. The Schmitt-trigger 458 changes state at exactly the predetermined low and high pressure levels. High pressure at the control port of these switches causes pressure venting at the switch outlet whereas no pressure at the control port means full pressure at the outlet. Switch 448 supplies pressure to chamber 454 in pump 410 (or to chamber 348 in pump 310).

The fluid under pressure enters volume 452 through a variable resistor 450 and is connected over conduit 456 to Schmitt-trigger 458. After a certain time lapse (as determined by resistor 450 and volume 452), the pressure in volume 452 reaches a sufficient level and this pressure is reflected at the control port of the Schmitt-trigger. This increased pressure signal causes the trigger to change state so that the air pressure in chamber 476 of pump 410 will be vented through the Schmitt-trigger. Also, the air from volume 462 now vents through fixed resistor 460 causing the pressure in volume 462 and at the control port of switch 466 to drop to zero.

Switch 466 now provides a pressurized discharge at its outlet, causing pressure in chamber 472 in pump 410 (or chamber 352 in pump 310) to increase. Pressure will now build up within volume 470 through resistor 468, which after a time period determined by resistor 468 and volume 470, will produce sufficient air pressure at the control port of switch 448 to change its state. This will vent air pressure from pump chamber 454 in pump 410.

The above-described half cycle is now repeated, however with the pressurizing and venting steps reversed, to complete a full cycle and to cause the pumping action of pump 410 (or 310).

Of course, it will be appreciated that all the switches might be Schmitt-triggers and all of the resistors might be variable resistors. Additionally, when a high speed of the pulse cycle is needed, it may be advantageous to bypass resistor 450 with a pneumatic check valve (indicated in dotted lines in FIG. 8) which allows unrestricted air flow from volume 456 to the outlet of switch 448, but restricted flow in the opposite direction. This check valve will cause an overlap in pressure-release from chamber 454 and pressure build-up in chamber 476. This does not cause pump valve leakage, as the middle valve is closed at this moment.

The sight glass 126 on the side of the cabint housing the pulse generator 116 provides a visual indication that the system is functioning properly.

The air operated diaphragm pumps 310 and 410, with their unique ability to discharge minute quantities of corrosive liquid in discrete pulses, are suggestive of other solutions to similar problems. Numerous modifications and revisions may occur to the skilled artisan. For example, the logic circuitry may assume diverse forms, including pure fluid components with the necessary number of amplifiers. Furthermore, although three displacer valves are disclosed, four or more may be utilized in conjunction with pneumatic logic circuitry capable of delivering four or more control pulses in the proper sequence and with the proper timing. Consequently, the appended claims should not be limited to their literal terms, but should be construed in a manner consistent with the material advance in the useful arts and sciences represented by the present invention.

What is claimed is:

1. A diaphragm pump for discharging minute quantities of liquid, said pump adapted to be submerged in a receptacle containing the liquid to be discharged, said pump comprising:

(a) a pump body composed of a plurality of segments, (b) an inlet port defined at the lower end of the body and an outlet port defined thereabove, (c) at least three spaced pumping chambers defined within said pump body between said inlet and outlet ports and in communication therewith, (d) conduits interconnecting said pumping chambers in series between said inlet and outlet ports, (e) at least one pumping diaphragm secured within said body between said segments to seal off one side of each pumping chamber, (f) at least three driving diaphragms secured with said pump body, each in association with a respective one of said pumping chambers, (g) at least three pressure chambers defined within said pump body, each in association with a respective one of said pumping chambers, a pulse generator connected between a supply of pressurized air and said pump body to deliver control pulses of air to said pressure chambers in a particular sequence and for a desired duration of time, and (i) at least three displacer valves secured to said pumping diaphragm and said driving diaphragms to draw fuid into said pump body through said inlet port, advance the fluid sequentially from pumping chamber to pumping chamber, and then discharge the fluid through said outlet port in discrete pulses, while preventing backflow through said pumping chambers, in response to said control pulses of air.

2. A diaphragm pump as defined in claim 1 wherein each driving diaphragm and said pumping diaphragm define an intermediate chamber therebetween, and means are provided for introducing a reference pressure into each intermediate chamber.

3. A diaphragm pump as defined in claim 1 wherein each displacer valve includes a cap with an aperture at one end and a button of chemically inert material that fits into said aperture.

4. A diaphragm pump as defined in claim 3 wherein the cap of each displacer valve further includes an enlarged annular shoulder, said shoulder guiding the movement of the displacer valve within each pumping chamber.

5. A diaphragm pump as defined in claim 3 wherein each displacer valve includes a spacer with a central bore extending therethrough, said spacer being secured between said driving diaphragm and said pumping diaphragm.

6. A diaphragm pump as defined in claim 1 wherein the pumping chambers are equal in volume.

7. A diaphragm pump as defined in claim 1 wherein there are three pumping diaphragms, each in association with a respective one of said pumping chambers.

* * * * *